US012448712B2

(12) United States Patent
Ho et al.

(10) Patent No.: US 12,448,712 B2
(45) Date of Patent: Oct. 21, 2025

(54) HORIZONTAL-AXIS SEWING THREAD OUTPUT STRUCTURE

(71) Applicant: KWONG LUNG ENTERPRISE CO., LTD., Taipei (TW)

(72) Inventors: Chun-Lung Ho, Taipei (TW); Rui-Lin Chen, Taipei (TW)

(73) Assignee: KWONG LUNG ENTERPRISE CO., LTD., Taipei (TW)

( * ) Notice: Subject to any disclaimer, the term of this patent is extended or adjusted under 35 U.S.C. 154(b) by 176 days.

(21) Appl. No.: 18/363,525

(22) Filed: Aug. 1, 2023

(65) Prior Publication Data

US 2024/0200249 A1 Jun. 20, 2024

(30) Foreign Application Priority Data

Dec. 16, 2022 (TW) ..... 111148823

(51) Int. Cl.
*D05B 43/00* (2006.01)

(52) U.S. Cl.
CPC ..... *D05B 43/00* (2013.01)

(58) Field of Classification Search
CPC ..... D05B 43/00; B65H 49/26; B65H 57/02; B65H 57/18; B65H 57/26; B65H 57/28
See application file for complete search history.

(56) References Cited

U.S. PATENT DOCUMENTS 1,486,610 A * 3/1924 Simmons ..... D05B 43/00 112/270
2012/0125245 A1* 5/2012 Troncoso ..... B65H 57/08 112/302

* cited by examiner

*Primary Examiner* — Nathan E Durham
(74) *Attorney, Agent, or Firm* — RABIN & BERDO, P.C.

(57) ABSTRACT

A horizontal-axis sewing thread output structure for use in a textile sewing machine includes a stator portion, a rotor portion, and a fixing portion. The stator portion is provided with a stator shaft that extends horizontally. The rotor portion is provided with a rotating member that can be rotated about an axis defined by the stator shaft and on which a sewing thread bobbin can be mounted. The fixing portion is configured to fix the sewing thread bobbin on the rotating member horizontally so that when outputting a sewing thread, the sewing thread bobbin can rotate naturally via the rotating member about the axis defined by the stator shaft, preventing the output sewing thread from being twisted. This helps reduce the instability factors of the manufacturing process of a sewn product and can lower the defect rate, and extend the service life, of the products manufactured.

17 Claims, 8 Drawing Sheets

HORIZONTAL-AXIS SEWING THREAD OUTPUT STRUCTURE

BACKGROUND OF THE INVENTION

1. Technical Field

The present invention relates to the sewing thread output structure of a textile sewing machine. More particularly, the invention relates to a horizontal-axis sewing thread output structure that allows a sewing thread bobbin to rotate in a horizontal position when outputting a sewing thread, lest the output sewing thread be subjected to a spiral shearing force.

2. Description of Related Art

Sewing is an essential step of the manufacturing processes of all textiles, and different sewing requirements have given rise to various sewing machines, some notable examples of which are lockstitch sewing machines, overlock sewing machines, coverstitch sewing machines, and quilting machines. The names of the sewing machines may seem difficult to understand, but the purpose of those sewing machines is nothing more than to join different pieces of fabric together, to secure a stuffing material, to enhance the look of a textile, and/or to fix an accessory in place.

Most of the existing sewing machines are so designed that a sewing thread is output from a sewing thread bobbin that stands upright. Referring to FIG. 1, a textile sewing machine 10' (which is a conventional computerized quilting machine by way of example) includes a machine body, a master control computer, a slide rail with a sliding base 12', a sewing thread supplying portion 11', and a sewing mechanism 13', among other components. The sewing thread supplying portion 11' is located above the sliding base 12' and is where a sewing thread bobbin 70' can be mounted or placed. The sewing thread output from the sewing thread bobbin 70' is first guided by the thread-guiding hole in a thread-guiding frame above the sewing thread bobbin 70' and then passed sequentially through the pre-tensioner, tension regulator, broken-thread sensor, take-up lever, and needle bar provided in the sewing mechanism 13' under the sliding base 12', before entering the needle eye and being used for sewing.

Such a vertical sewing thread output mode, however, has the following drawbacks. Referring to FIG. 2, the sewing thread pulled off (i.e., output from) the bobbin by the pulling force of the sewing operation is twisted. The greater the length of the output sewing thread is, the more twisted the sewing thread will be. As the twist generates an increasing shearing force, the sewing thread will break when the shearing force exceeds the yield strength of the sewing thread. Even if the sewing thread output from such a vertical-axis sewing thread output structure does not break during the sewing process, the shearing force generated by the twist will keep acting on the sewing thread such that the sewing thread stays taut in the sewn product. The sewn product, therefore, will have quality and durability issues because a broken thread or even unstitching is very likely to occur.

In short, the conventional vertical-axis sewing thread output mode will cause a sewing thread to twist while the sewing thread is being output, thereby subjecting the sewing thread to both a pulling force and shear stress. If the output sewing thread is overly twisted and ends up tightly stretched, a variety of consequences may arise. For example, during the sewing process, a shell fabric may become unstitched because of a broken thread, thus leading to a high defect rate, considerable reworking time, and low productivity. As far as a finished product is concerned, an excessively tight sewing thread may also result in unstitching of the shell fabric when broken, such that the quality and durability of the product are compromised. When it comes to the use of a sewn product, an extremely taut sewing thread may also break and cause unstitching due to the pulling or stretching force of the washing operation of a washing machine.

When sewing a high stitch count bedding product such as a mattress, it is common to have a sewing thread broken by the shearing force generated during the sewing process. In addition, a sewn product operator seldom views a premature broken thread or premature unstitching as a problem of quality or durability. However, the inventors did not take the above for granted, and found that the presence of excessive twist or shear stress in a sewing thread has long been an issue in the industry.

In view of the above, and by keeping up his research spirit, the inventor of the present invention has found the following through extensive tests and observation. First, the thread output path of the vertical-axis sewing thread output mode tends to cause a twisted (rotated) sewing thread. Second, although a sewing thread does not break at a fixed time during the sewing process, the higher the stitch count (the longer the sewing distance), the more likely the occurrence of a broken thread; that is to say, the SPI has a positive correlation with the tautness of a sewing thread. Third, a sewing thread happens yield phenomenon, and then breaks, when it is so twisted that its maximum tautness is exceeded. The inventor worked persistently to find ways of improvement and finally succeeded in developing the horizontal-axis sewing thread output structure disclosed herein.

BRIEF SUMMARY OF THE INVENTION

The primary objective of the present invention is to provide a horizontal-axis sewing thread output structure for use in a textile sewing machine. By allowing a sewing thread bobbin to rotate in a horizontal position while outputting a sewing thread, the sewing thread is kept from being twisted during the sewing process, and this helps reduce the instability factors of the manufacturing process of a sewn product.

Furthermore, by changing the sewing thread output mode from the conventional vertical one to a horizontal one to keep a sewing thread from being twisted while the sewing thread is being guided away from the bobbin, the present invention prevents the output sewing thread from being subjected to the shearing force that may otherwise be caused by the twist. Once sewing is completed, the sewing thread in the finished product will not be in a twisted state either. Thus, the defect rate of textile products can be effectively reduced, and their service life extended.

To achieve the foregoing and other objectives and effects, the major technical means adopted by the horizontal-axis sewing thread output structure of the present invention include a stator portion, a rotor portion, and a fixing portion. The stator portion is fixed to the sewing thread supplying portion of a textile sewing machine, wherein the sewing thread supplying portion is where a sewing thread bobbin is mounted or placed. The stator portion is provided with a stator shaft that extends horizontally. The rotor portion is coupled to the stator portion and includes a rotating member configured to be rotated about an axis defined by the stator shaft. The end of the rotating member that is located away from the stator shaft is configured to be inserted into the sewing thread bobbin such that the sewing thread bobbin is mounted on the rotating member and can rotate via the rotating member about the axis defined by the stator shaft. The fixing portion includes a first positioning member and a second positioning member, both configured to fix the sewing thread bobbin in position. The first positioning member is provided at the end of the rotating member that is adjacent to the stator shaft, and the first positioning member is configured to abut against a tail portion of the sewing thread bobbin. The second positioning member is detachably joined to the rotating member and is at the end of the rotating member that is located away from the stator shaft. The second positioning member is configured to abut against a head portion of the sewing thread bobbin. The first positioning member and the second positioning member can clamp the sewing thread bobbin in position such that the sewing thread bobbin is fixed on the rotating member in a horizontal position and, when outputting a sewing thread, can rotate naturally via the rotating member about the axis defined by the stator shaft.

The foregoing structure may be so designed that the rotor portion is coupled to the stator portion via at least one bearing; that the rotating member is in the shape of a bar; that the end of the rotating member that is adjacent to the stator shaft has a larger outer diameter than the end of the rotating member that is located away from the stator shaft; that the rotating member is formed therein with a hollow portion such that the rotating member can be mounted on and around the stator shaft, with the inner surface of the hollow portion of the rotating member coupled to the stator shaft via the at least one bearing; and that the at least one bearing includes an inner ring (also known as an inner race) and an outer ring (also known as an outer race) that are rotatable with respect to each other, with the inner ring joined to the surface of the stator shaft, and the outer ring joined to the inner surface of the rotating member.

The number of the at least one bearing may be plural, and in that case the plural bearings are coupled between, and arranged at intervals along, the stator shaft and the rotating member.

The foregoing structure may be so designed that the first positioning member is a tapered annular member with a tapered outer surface, and that the position at which the second positioning member is joined to the rotating member can be adjusted with respect to the rotating member, in order for the sewing thread bobbin to be clamped in position by the two positioning members and securely mounted on the rotating member.

In a preferred embodiment where the sewing thread supplying portion of the textile sewing machine has a suitable supporting frame to which the stator portion can be securely joined, the stator portion is so designed that the end of the stator shaft that is located away from the rotating member can be inserted through and fixed to the supporting frame.

In a preferred embodiment where the sewing thread supplying portion of the textile sewing machine lacks a suitable structure to which the stator portion can be directly and securely joined, the stator portion is fixed to a suitable supporting member of the sewing thread supplying portion via a supporting post and a supporting block, with the end of the stator shaft that is located away from the rotating member inserted through and fixed to the top end of the supporting post, the bottom end of the supporting post inserted through and fixed to the supporting block, and a lateral side of the supporting block securely joined to the supporting member.

The supporting post may be further provided with a pressing unit and a through hole, wherein the pressing unit is configured to be inserted through the through hole and pressed tightly against the stator shaft. In addition, a rubber pad may be provided between the supporting block and the supporting member to provide additional friction, and a side of the supporting block that is adjacent to the rotating member may be vertically penetrated by a thread-guiding hole.

The textile sewing machine may include a sliding base for driving a sewing mechanism into motion, and in that case the sewing thread supplying portion is provided on the sliding base. The textile sewing machine may be a lockstitch sewing machine, an overlock sewing machine, a coverstitch sewing machine, a quilting machine, or a computerized quilting machine, wherein the lockstitch sewing machine may be a single-needle lockstitch sewing machine, a double-needle lockstitch sewing machine, or a multiple-needle lockstitch sewing machine, and wherein the computerized quilting machine may be a computerized single-needle quilting machine or a computerized multiple-needle quilting machine.

The present invention uses a unique horizontal-axis design in place of the conventional vertical-axis mode so that a sewing thread that is being output from a bobbin will be subjected to only a pulling force rather than a combination of a pulling force and shear stress as is conventionally the case. During the entire sewing process, therefore, the sewing thread will not be rotated or twisted unnecessarily, and this advantageously contributes to increasing the quality and efficiency of the sewing process and the quality and service life of the sewn product.

Furthermore, the horizontal-axis structure of the present invention is so designed that the stator portion (or the stator shaft to be exact) requires high rigidity and is therefore preferably made of tool steel, stainless steel, or other similar rigid materials; that the rotor portion (or the rotating member to be exact) requires a small moment of inertia and light weight and is therefore preferably made of an aluminum alloy or other similar lightweight alloys; and that the at least one bearing may be a low-friction ball bearing that, due to considerations related to service life and the ease of replacement, is not preloaded and is mounted with a clearance fit, e.g., by being secured with a washer and a nut. In addition, to prevent the sewing thread bobbin mounted on the rotating member from having any amount of unbalance, the first positioning member and the second positioning member provided respectively at the two ends of the sewing thread bobbin to clamp the sewing thread bobbin in position may be tapered annular members or washers (e.g., bowl-shaped washers), so that the sewing thread bobbin can be automatically centered when rotating about the horizontal stator shaft.

BRIEF DESCRIPTION OF THE SEVERAL VIEWS OF THE DRAWINGS

The aforesaid and other objectives, effects, and features of the present invention can be better understood by referring to the following detailed description in conjunction with the accompanying drawings.

DETAILED DESCRIPTION OF THE INVENTION

Figure 1:
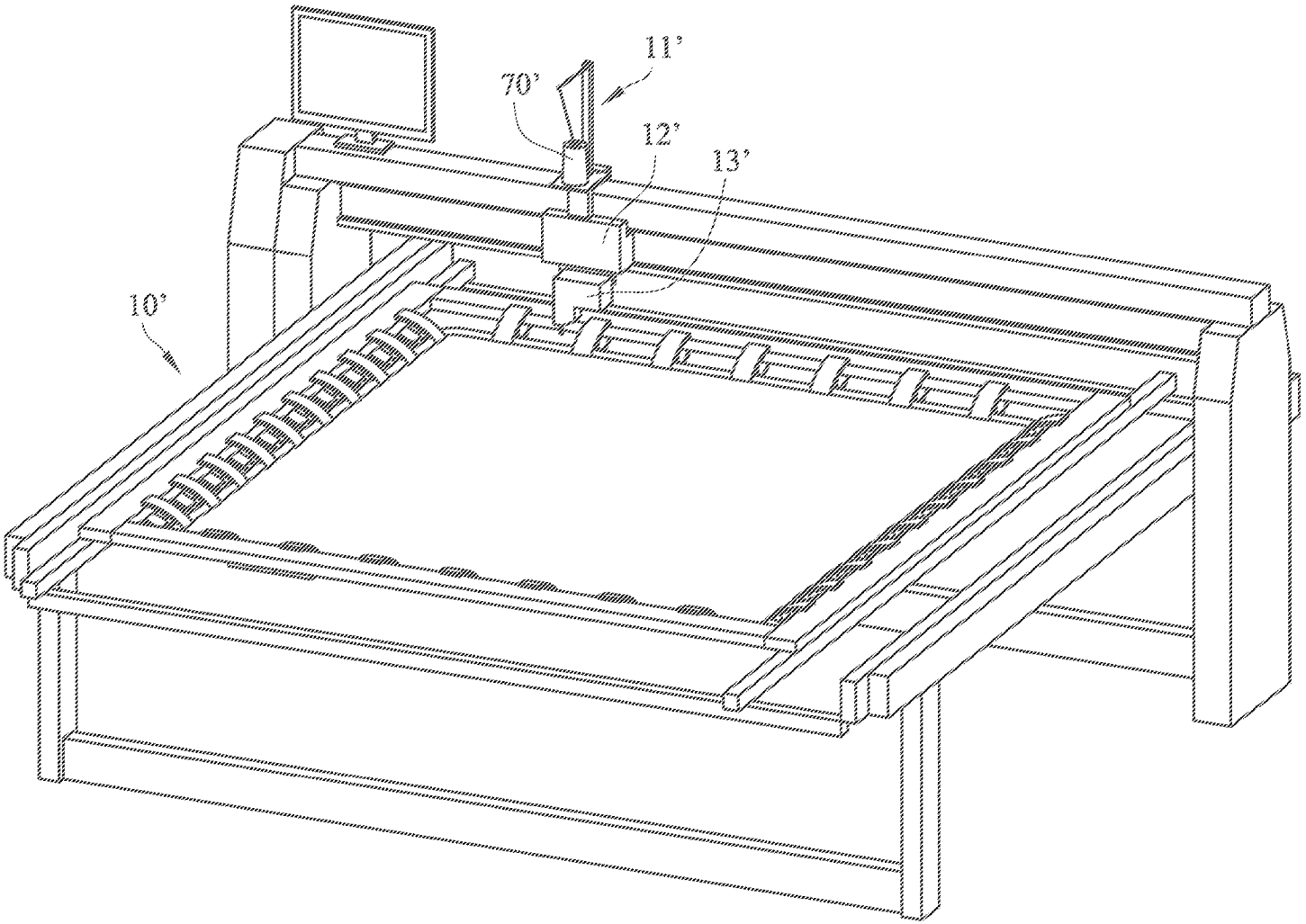
FIG. 1 (Prior Art)
FIG. 1 is a perspective view of a conventional textile sewing machine.
Figure 2:
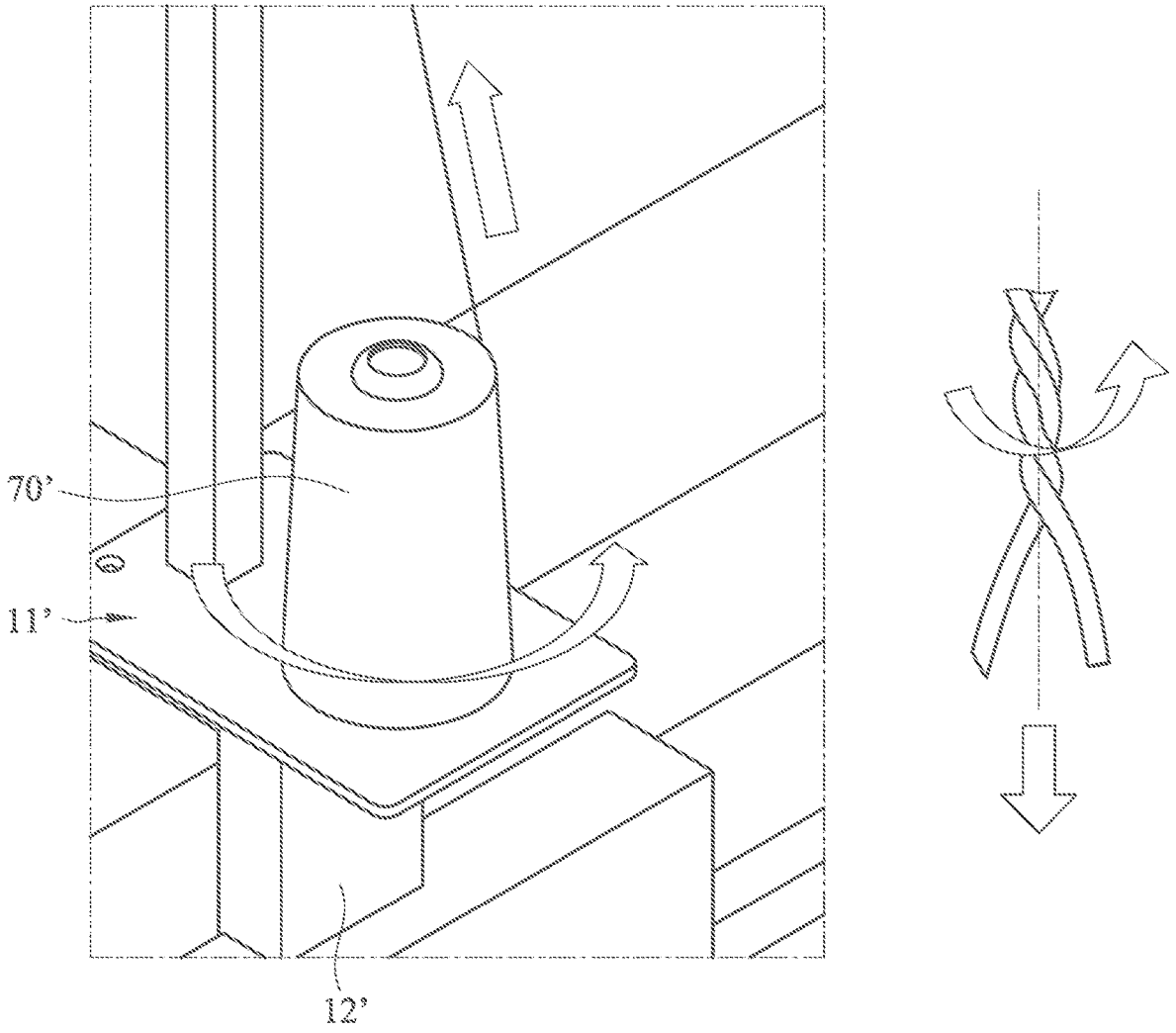
FIG. 2 (Prior Art)
FIG. 2 shows the conventional vertical-axis sewing thread output mode and the forces acting on a sewing thread as a result of this output mode.

Referring to FIG. 3 to FIG. 6, the horizontal-axis sewing thread output structure according to an embodiment of the present invention essentially includes a stator portion 20, a rotor portion 30, and a fixing portion 50 so as to provide an improvement over the prior art. The horizontal-axis sewing thread output structure is used in a textile sewing machine 10 (which is shown in its entirety in FIG. 1) and is provided at a sewing thread supplying portion 11 of the textile sewing machine 10. The sewing thread supplying portion 11 is usually mounted on a movable sliding base 12 of the textile sewing machine 10.

The stator portion 20 is fixed to the sewing thread supplying portion 11. In this embodiment, the sewing thread supplying portion 11 is provided with a supporting frame 111 on which the stator portion 20 can be mounted, and the stator portion 20 has a stator shaft 21 that extends horizontally. One end of the stator shaft 21 extends through the supporting frame 111 and is fixed in place by a nut. The other end of the stator shaft 21 forms a free end that extends horizontally from the supporting frame 111.

The rotor portion 30 is coupled to the free end of the stator shaft 21 and essentially includes a rotating member 31 configured to be rotated about an axis defined by the stator shaft 21. A sewing thread bobbin 70 can be mounted on and around the rotating member 31 so as to rotate via the rotating member 31 about the axis defined by the stator shaft 21. In this embodiment, the rotating member 31 is in the shape of a bar, is configured to be mounted on and around the stator shaft 21, and is formed with an internal hollow portion 32 in communication with the free end of the stator shaft 21. Moreover, the end of the rotating member 31 that corresponds to the stator shaft 21 has a larger outer diameter than the end of the rotating member 31 that is located away from the stator shaft 21 so that the sewing thread bobbin 70 can be mounted on the rotating member 31 from the end of the rotating member 31 that is located away from the stator shaft 21. The hollow portion 32 of the rotating member 31 has an inner surface 33. The inner surface 33 is coupled to the surface 22 of the stator shaft 21 via two bearings 40 that are spaced apart from each other. Each bearing 40 is a low-friction ball bearing and includes an inner ring 41, an outer ring 42, and a plurality of balls 43 provided between the inner ring 41 and the outer ring 42 so that the two rings can rotate with respect to each other in a low-friction manner via the balls 43. The inner rings 41 are securely joined to the surface 22 of the stator shaft 21, and the outer rings 42 are securely joined to the inner surface 33 of the rotating member 31. The rotating member 31, therefore, can rotate naturally in a low-friction manner via the two bearings 40 about the axis defined by the stator shaft 21.

The fixing portion 50 is mounted on the rotating member 31 to help secure the sewing thread bobbin 70 on the rotating member 31. The fixing portion 50 includes a first positioning member 51 and a second positioning member 52. The first positioning member 51 is provided at the end of the rotating member 31 that is adjacent to the stator shaft 21. The first positioning member 51 is configured to abut against a tail portion of the sewing thread bobbin 70. The second positioning member 52 is detachably joined to the rotating member 31, or more specifically to the end of the rotating member 31 that is located away from the stator shaft 21. The second positioning member 52 can be adjusted in position with respect to the rotating member 31 and is configured to abut against a head portion of the sewing thread bobbin 70. Once the sewing thread bobbin 70 is mounted on the rotating member 31, the first positioning member 51 and the second positioning member 52 can clamp the sewing thread bobbin 70 in position such that the sewing thread bobbin 70 is not only fixed on the rotating member 31 horizontally, but also allowed to rotate in a natural manner via the rotating member 31 about the axis defined by the stator shaft 21 while a sewing thread is being output from the sewing thread bobbin 70, thereby preventing the output sewing thread from being twisted.

In this embodiment, the first positioning member 51 and the second positioning member 52 are annular members having a tapered outer surface. More specifically, the first positioning member 51 is a tapered, or truncated-conical, annular member having a tapered, or truncated-conical, outer surface, and the second positioning member 52 is a bowl-shaped washer configured to be fixed in position by a nut. Thanks to the configurations of the two positioning members, the sewing thread bobbin 70 securely mounted on the rotating member 31 can be automatically centered when rotating about the horizontal stator shaft 21.

Figure 3:
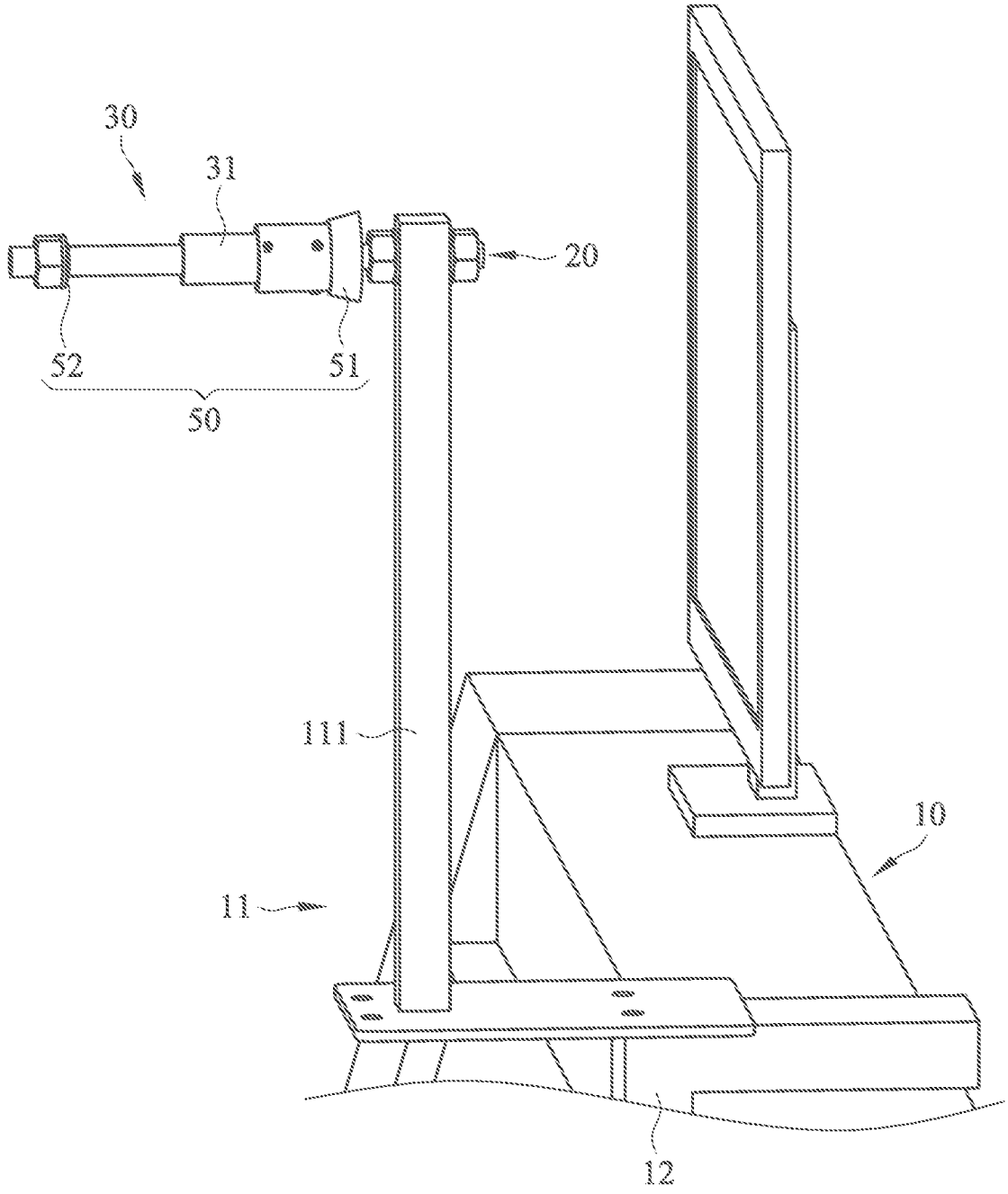
FIG. 3 is a perspective view showing an embodiment of the present invention used in a textile sewing machine.
Figure 4:
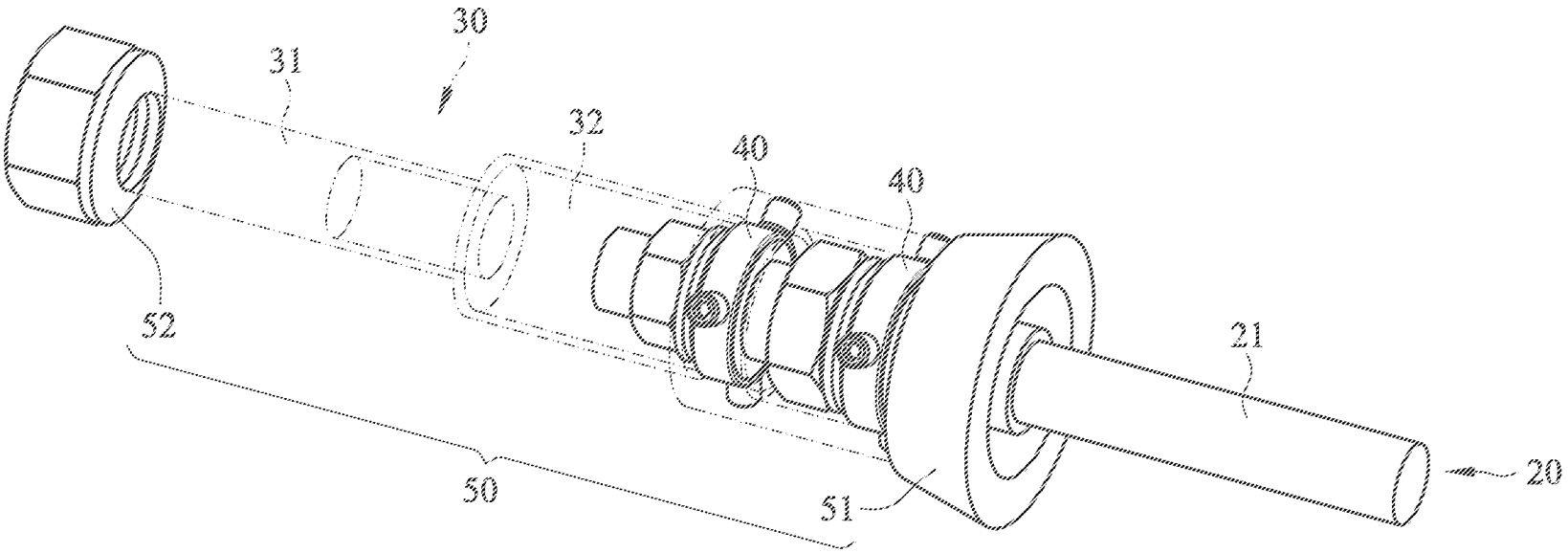
FIG. 4 is a perspective view showing the structural details of the embodiment in FIG. 3.
Figure 5:
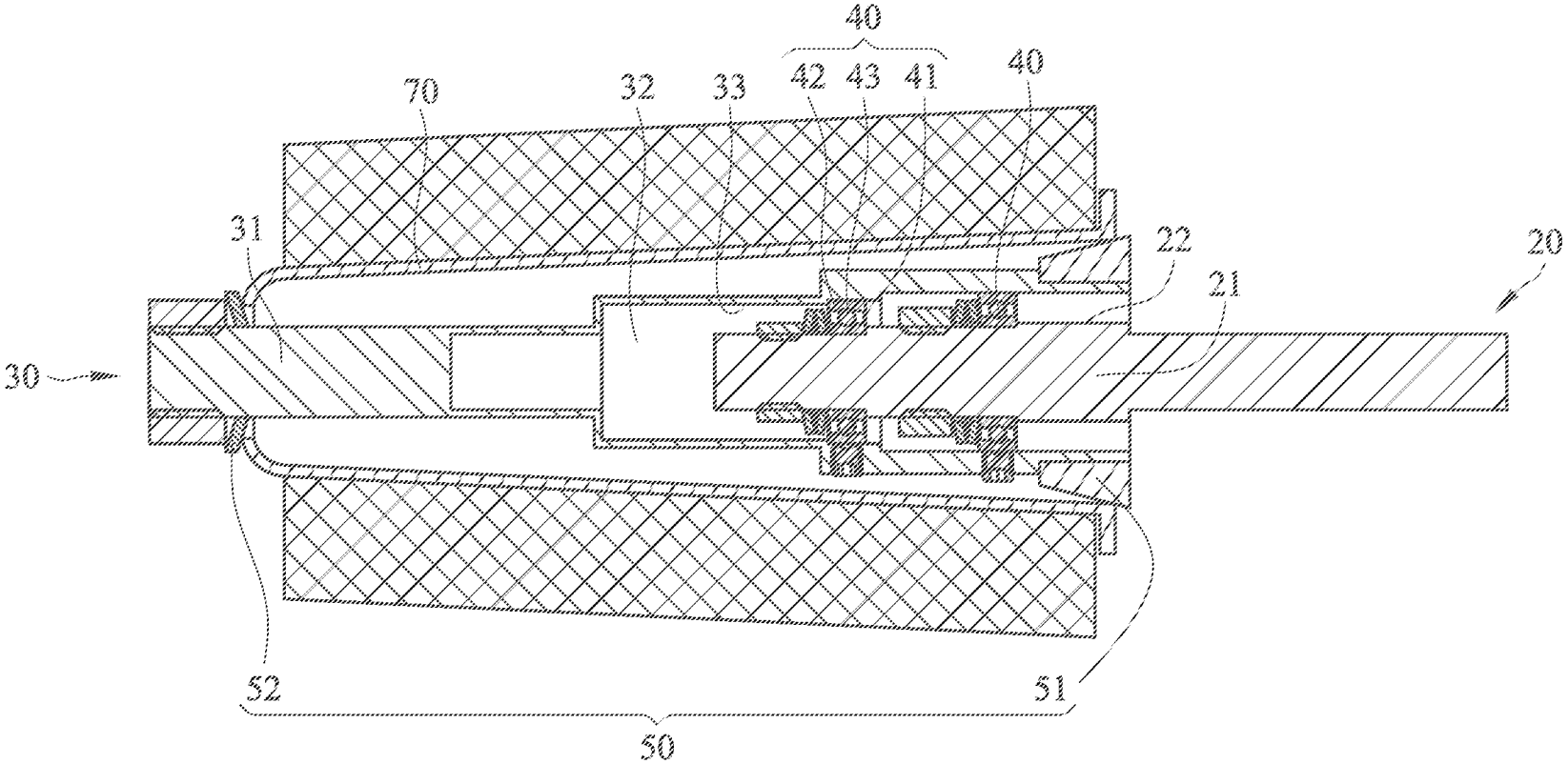
FIG. 5 is a sectional view showing the structural details of the embodiment in FIG. 3.
Figure 6:
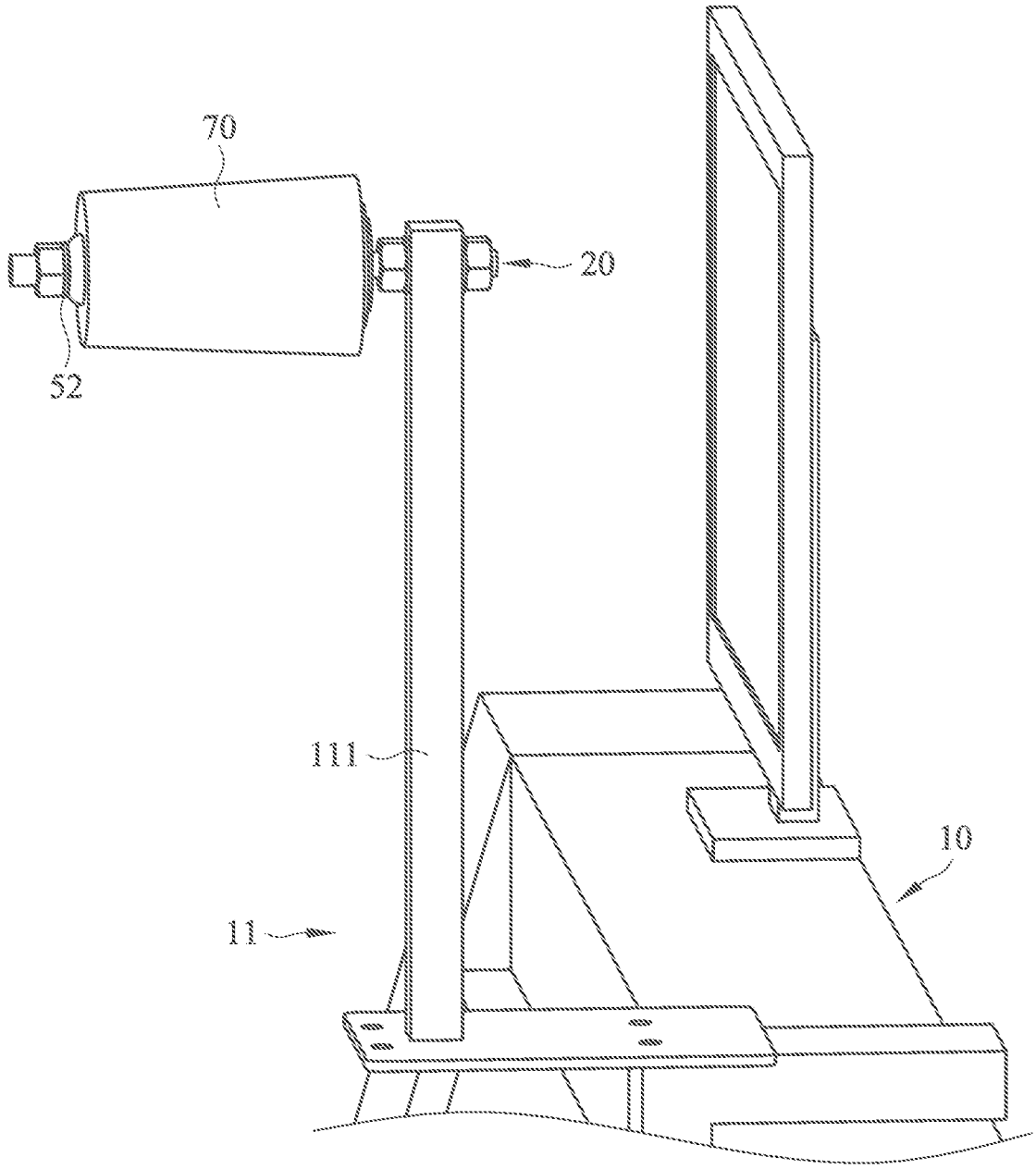
FIG. 6 is similar to FIG. 3 except that a sewing thread bobbin has been mounted in place.
Figure 7:
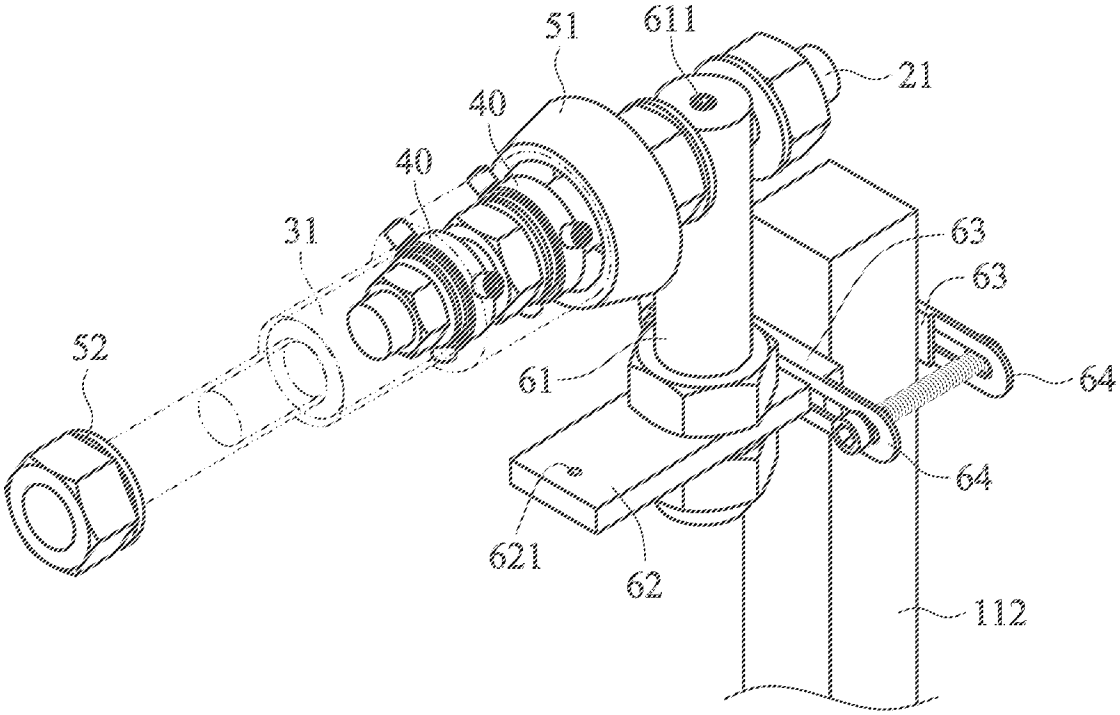
FIG. 7 is a perspective view showing the embodiment used in a textile sewing machine together with a supporting assembly.
Figure 8:
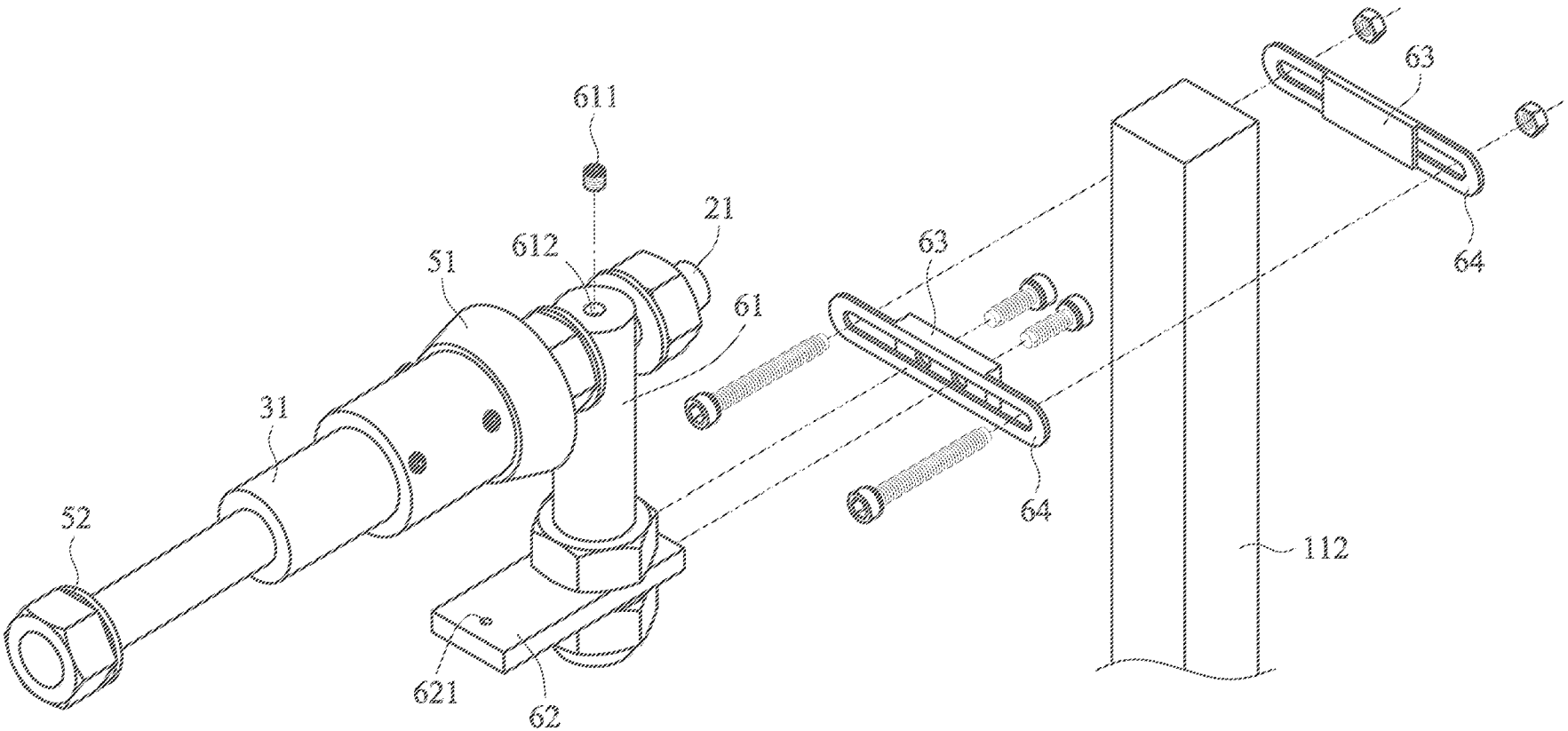
FIG. 8 is an exploded perspective view showing how the embodiment is used together with the supporting assembly in FIG. 7.

FIG. 3 and FIG. 6 show the foregoing embodiment used in the textile sewing machine 10. The existing supporting frame 111 (e.g., the existing thread-guiding frame) of the sewing thread supplying portion 11 of the textile sewing machine 10 is designed for supporting and fixing purposes and therefore can be directly modified to adapt to the horizontal-axis sewing thread output structure of the present invention. If the existing thread-guiding frame cannot be used for supporting and fixing purposes, referring to FIG. 7 and FIG. 8, the horizontal-axis sewing thread output structure in the foregoing embodiment can be mounted on a suitable supporting member 112 of the sewing thread supplying portion 11 via a supporting assembly.

The supporting assembly essentially includes a supporting post 61 and a supporting block 62. The end of the stator shaft 21 that is located away from the rotating member 31 is inserted through and fixed to the top end of the supporting post 61. The bottom end of the supporting post 61 is inserted through and fixed to the supporting block 62. A lateral side of the supporting block 62 is first connected to a locking plate 64 with a rubber pad 63 and then securely joined to the supporting member 112 via another locking plate 64 with a rubber pad 63. The rubber pad 63 between the supporting block 62 and the supporting member 112 serves to increase friction and protect the machine from being scratched. The mounting structure of the supporting assembly may be so designed that the top end of the supporting post 61 is further provided with a pressing unit 611 and a through hole 612, wherein the pressing unit 611 is inserted through the through hole 612 and pressed tightly against a lateral side of the stator shaft 21 to fix the stator shaft 21 in position. Moreover, a side of the supporting block 62 that is adjacent to the rotating member 31 may be vertically penetrated by a thread-guiding hole 621 near the edge to help maintain the thread output path.

The embodiments described above are only some preferred ones of the present invention. Any change, modification, alteration, or equivalent substitution made according to, or derived from, the technical means of the invention shall fall within the scope of the appended claims.

What is claimed is:

1. A horizontal-axis sewing thread output structure, for use in a textile sewing machine, wherein the textile sewing machine is provided at least with a sewing thread supplying portion where a sewing thread bobbin is mounted or placed, the horizontal-axis sewing thread output structure being characterized by comprising a stator portion, a rotor portion, and a fixing portion, wherein:

the stator portion is fixed to the sewing thread supplying portion and is provided with a horizontally extending stator shaft;

the rotor portion is coupled to the stator portion and includes a rotating member configured to be rotated about an axis defined by the stator shaft, wherein the rotating member has an end located away from the stator shaft and configured to be inserted into the sewing thread bobbin such that the sewing thread bobbin is mounted on the rotating member and is rotatable via the rotating member about the axis defined by the stator shaft;

the fixing portion includes a first positioning member and a second positioning member, both configured to fix the sewing thread bobbin in position, the first positioning member is provided at an end of the rotating member that is adjacent to the stator shaft, the first positioning member is configured to abut against a tail portion of the sewing thread bobbin, the second positioning member is detachably joined to the rotating member and is at an end of the rotating member that is located away from the stator shaft, and the second positioning member is configured to abut against a head portion of the sewing thread bobbin; and the first positioning member and the second positioning member are able to clamp the sewing thread bobbin in position such that the sewing thread bobbin is fixed on the rotating member horizontally and, when outputting a sewing thread, is rotatable in a natural manner via the rotating member about the axis defined by the stator shaft;

wherein the rotor portion is coupled to the stator portion via at least one bearing;

wherein the rotating member is bar-shaped and is formed therein with a hollow portion to allow the rotating member to be mounted on and around the stator shaft, with an inner surface of the hollow portion of the rotating member coupled to the stator shaft via the at least one bearing; and wherein the at least one bearing includes an inner ring and an outer ring, the inner ring and the outer ring are rotatable with respect to each other, the inner ring is joined to a surface of the stator shaft, and the outer ring is joined to the inner surface of the rotating member.

2. The horizontal-axis sewing thread output structure of claim 1, wherein the end of the rotating member that is adjacent to the stator shaft has a larger outer diameter than the end of the rotating member that is located away from the stator shaft.

3. The horizontal-axis sewing thread output structure of claim 2, wherein the at least one bearing includes an inner ring and an outer ring, the inner ring and the outer ring are rotatable with respect to each other, the inner ring is joined to a surface of the stator shaft, and the outer ring is joined to the inner surface of the rotating member.

4. The horizontal-axis sewing thread output structure of claim 3, wherein a number of the at least one bearing is plural, and the plural bearings are coupled between, and arranged at intervals along, the stator shaft and the rotating member.

5. The horizontal-axis sewing thread output structure of claim 4, wherein the first positioning member is a tapered annular member having a tapered outer surface, and the second positioning member is joined to the rotating member in such a way that the second positioning member is adjustable in position with respect to the rotating member, in order for the sewing thread bobbin to be clamped in position by the first positioning member and the second positioning member and thus securely mounted on the rotating member.

6. The horizontal-axis sewing thread output structure of claim 5, wherein the stator shaft of the stator portion has an end located away from the rotating member and inserted through and fixed to a supporting frame of the sewing thread supplying portion.

7. The horizontal-axis sewing thread output structure of claim 5, wherein the stator portion is fixed to a supporting member of the sewing thread supplying portion via a supporting post and a supporting block, the stator shaft has an end located away from the rotating member and inserted through and fixed to a top end of the supporting post, the supporting post has a bottom end inserted through and fixed to the supporting block, and the supporting block has a lateral side securely joined to the supporting member.

8. The horizontal-axis sewing thread output structure of claim 7, wherein the supporting post is provided with a pressing unit and a through hole, and the pressing unit is configured to be inserted through the through hole and pressed tightly against the stator shaft to fix the stator shaft in position.

9. The horizontal-axis sewing thread output structure of claim 1, wherein a number of the at least one bearing is plural, and the plural bearings are coupled between, and arranged at intervals along, the stator shaft and the rotating member.

10. The horizontal-axis sewing thread output structure of claim 9, wherein the first positioning member is a tapered annular member having a tapered outer surface, and the second positioning member is joined to the rotating member in such a way that the second positioning member is adjustable in position with respect to the rotating member, in order for the sewing thread bobbin to be clamped in position by the first positioning member and the second positioning member and thus securely mounted on the rotating member.

11. The horizontal-axis sewing thread output structure of claim 10, wherein the stator shaft of the stator portion has an end located away from the rotating member and inserted through and fixed to a supporting frame of the sewing thread supplying portion.

12. The horizontal-axis sewing thread output structure of claim 10, wherein the stator portion is fixed to a supporting member of the sewing thread supplying portion via a supporting post and a supporting block, the stator shaft has an end located away from the rotating member and inserted through and fixed to a top end of the supporting post, the supporting post has a bottom end inserted through and fixed to the supporting block, and the supporting block has a lateral side securely joined to the supporting member.

13. The horizontal-axis sewing thread output structure of claim 12, wherein the supporting post is provided with a pressing unit and a through hole, and the pressing unit is configured to be inserted through the through hole and pressed tightly against the stator shaft to fix the stator shaft in position.

14. The horizontal-axis sewing thread output structure of claim 13, wherein a rubber pad is provided between the supporting block and the supporting member to provide additional friction.

15. The horizontal-axis sewing thread output structure of claim 14, wherein the supporting block has a side adjacent to the rotating member and vertically penetrated by a thread-guiding hole.

16. The horizontal-axis sewing thread output structure of claim 15, wherein the textile sewing machine further includes a sliding base for driving a sewing mechanism into motion, and the sewing thread supplying portion is provided on the sliding base.

17. The horizontal-axis sewing thread output structure of claim 15, wherein the textile sewing machine is one of a lockstitch sewing machine, an overlock sewing machine, a coverstitch sewing machine, a quilting machine, and a computerized quilting machine; the lockstitch sewing machine is a single-needle lockstitch sewing machine, a double-needle lockstitch sewing machine, or a multiple-needle lockstitch sewing machine; and the computerized quilting machine is a computerized single-needle quilting machine or a computerized multiple-needle quilting machine.

* * * * *